US008892008B2

(12) United States Patent
Harpur et al.

(10) Patent No.: US 8,892,008 B2
(45) Date of Patent: Nov. 18, 2014

(54) METHOD AND APPARATUS FOR REDUCING RESIDUAL TONER IN A ROTATING CONTAINER

(71) Applicant: Xerox Corporation, Norwalk, CT (US)

(72) Inventors: Ian G. Harpur, Welwyn Garden City (GB); Michael John Wilsher, Letchworth (GB); Richard David Emms, Welwyn Garden City (GB); Derek William Judd, Stevenage (GB)

(73) Assignee: Xerox Corporation, Norwalk, CT (US)

( * ) Notice: Subject to any disclaimer, the term of this patent is extended or adjusted under 35 U.S.C. 154(b) by 29 days.

(21) Appl. No.: 13/797,969

(22) Filed: Mar. 12, 2013

(65) Prior Publication Data

US 2014/0270857 A1 Sep. 18, 2014

(51) Int. Cl.
*G03G 15/08* (2006.01)

(52) U.S. Cl.
CPC ..... *G03G 15/0836* (2013.01)
USPC ..... 399/263; 399/262; 399/254

(58) Field of Classification Search
USPC ..... 399/254, 262, 263
See application file for complete search history.

(56) References Cited

U.S. PATENT DOCUMENTS

| | | | | |
|---|---|---|---|---|
| 4,739,907 | A | 4/1988 | Gallant | |
| 4,943,830 | A | 7/1990 | Sulenski | |
| 4,963,939 | A * | 10/1990 | Kurando et al. | 399/12 |
| 5,184,181 | A * | 2/1993 | Kurando et al. | 399/262 |
| 5,699,842 | A | 12/1997 | Wegman | |
| 5,774,772 | A * | 6/1998 | Kai et al. | 399/260 |
| 5,822,653 | A * | 10/1998 | Ishii | 399/104 |
| 7,062,198 | B2 * | 6/2006 | Oda | 399/107 |
| 7,088,930 | B2 | 8/2006 | Mimura | |
| 7,881,642 | B2 | 2/2011 | Walsh et al. | |
| 7,904,007 | B2 * | 3/2011 | Takesue et al. | 399/263 |
| 8,055,163 | B2 * | 11/2011 | Kurimoto et al. | 399/263 |
| 2011/0234238 | A1 * | 9/2011 | Herrman et al. | 324/551 |

* cited by examiner

*Primary Examiner* — Clayton E Laballe
*Assistant Examiner* — Trevor J Bervik
(74) *Attorney, Agent, or Firm* — Ronald E. Prass, Jr.; Prass LLP

(57) ABSTRACT

An approach is provided for reducing an amount of residual toner remaining in a rotating container. The approach involves rotating a rotatable vessel configured to contain a toner. The approach also involves a causing a plurality of beads that include at least one material configured to be attracted to a magnetic strip that extends in a direction parallel to an axial direction of movement of the toner between a first end and a second end of the vessel. The plurality of beads, when attracted to the magnetic strip, cooperate with helical features of the vessel and the internal surface of a body section of the vessel to transport at least a portion of the toner in an axial direction from the first end of the vessel to the second end of the vessel as the vessel is rotated.

12 Claims, 4 Drawing Sheets

METHOD AND APPARATUS FOR REDUCING RESIDUAL TONER IN A ROTATING CONTAINER

RELATED APPLICATIONS

This application is related to the following co-pending applications, each of which is hereby incorporated herein by reference in its entirety: U.S. patent application Ser. No. 13/691,693, filed Nov. 30, 2012, entitled "SYSTEMS AND METHODS FOR FACILITATING ADVANCED TONER DISPENSING FROM ROTATING TONER CARTRIDGE COMPONENTS," by Gerardo Leute, U.S. patent application Ser. No. 13/797,714, filed Mar. 12, 2013, entitled "METHOD AND APPARATUS FOR REDUCING RESIDUAL TONER IN A ROTATING CONTAINER," by Paul Wegman, and U.S. patent application Ser. No. 13/797,879, filed Mar. 12, 2013, entitled "METHOD AND APPARATUS FOR REDUCING RESIDUAL TONER IN A ROTATING CONTAINER," by Paul Wegman.

FIELD OF DISCLOSURE

This disclosure relates to an apparatus, method and system for reducing residual toner in a rotating container useful in printing.

BACKGROUND

Some image forming devices use powdered toner as the marking material for image forming on image receiving substrates. The term "toner" generally refers to a powder used as the marking material in image forming devices such as xerographic image forming devices, laser printers and photocopiers to form printed text and images on image receiving substrates.

Toner is typically packaged in containers of differing sizes, shapes and compositions. The containers may be generically referred to as "toner cartridges." Toner cartridges are often closed containers in which the toner is conveniently packaged for supply to customers and/or end users. Toner cartridges are customer replaceable consumable components that the customers or end-users install as complete replacement units in the image forming devices, which may be opened for access to the toner by an image forming device once the toner cartridge is installed in the image forming device Toner cartridge manufacturers are continually challenged with maximizing toner cartridge life expectancy and reducing waste. As a toner cartridge is used, an image forming device may indicate that a toner cartridge is empty, or a user may determine that a toner cartridge is empty based on print quality. But, residual amounts of usable toner may still remain in the toner cartridge despite a determination that a toner cartridge is empty.

U.S. Pat. No. 5,699,842 discusses a process for filling and dispersing the contents of a container, and is hereby incorporated by reference in its entirety.

SUMMARY

Therefore, there is a need for an approach to reduce residual toner in a rotating container useful in printing.

According to one embodiment, an apparatus useful in printing comprises a rotatable vessel configured to contain a toner. The vessel comprises a body section having a substantially round cross-section, a first end at one axial end of the body section, a second end axially distal the first end, and helical features on an internal surface of the body section configured to transport at least a portion of the toner in an axial direction between the first end and the second end as the vessel is rotated. The apparatus further comprises a magnetic strip configured to extend in a direction parallel to the axial direction between the first end and the second end of the vessel. The apparatus also comprises a plurality of beads comprising at least one material configured to be attracted to the magnetic strip.

According to another embodiment, a method useful in printing comprises causing, at least in part, a rotatable vessel configured to contain a toner to be rotated. The vessel comprises a body section having a substantially round cross-section, a first end at one axial end of the body section, a second end axially distal the first end, and helical features on an internal surface of the body section configured to transport at least a portion of the toner in an axial direction between the first end and the second end as the vessel is rotated. The method further comprises causing, at least in part, a plurality of beads to be attracted to a magnetic strip. The magnetic strip is configured to extend in a direction parallel to the axial direction between the first end and the second end of the vessel.

According to another embodiment, an image forming device comprises an image marking device and at least one rotating toner delivery container. The at least one rotating toner deliver container comprises a rotatable vessel configured to contain a toner, the vessel comprising a body section having a substantially round cross-section, a first end at one axial end of the body section, a second end axially distal the first end, and helical features on an internal surface of the body section configured to transport at least a portion of the toner in an axial direction between the first end and the second end as the vessel is rotated. The at least one rotating toner delivery container further comprises a magnetic strip configured to extend in a direction parallel to the axial direction between the first end and the second end of the vessel. The at least one rotating toner delivery container also comprises a plurality of beads comprising at least one material configured to be attracted to the magnetic strip.

According to another embodiment, a method of filling a container with a toner material useful in printing comprises providing a vessel configured to contain a toner, the vessel comprising a body section having a substantially round cross-section, a first end at one axial end of the body section, a second end axially distal the first end, and helical features on an internal surface of the body section, the helical features being configured to transport the toner in an axial direction between the first end and the second end as the vessel is rotated by an image forming device. The method also comprises causing, at least in part, the vessel to be filled with the toner. The method further comprises causing, at least in part, a plurality of beads comprising at least one material configured to be attracted to a magnetic strip to be input into the vessel.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments are illustrated by way of example, and not by way of limitation, in the figures of the accompanying drawings.

DETAILED DESCRIPTION

Examples of a method, apparatus, and system for reducing residual toner in a rotating container useful in printing are disclosed. In the following description, for the purposes of explanation, numerous specific details are set forth in order to provide a thorough understanding of the embodiments. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

The systems and methods for reducing residual toner in a rotating container according to this disclosure will generally refer to this specific utility for those systems and methods. Exemplary embodiments described and depicted in this disclosure should not be interpreted as being specifically limited to any particular configuration of a rotating toner bottle, cartridge or dispenser, including a plastic or injection molded bottle, cartridge or dispenser. It should be recognized that advantageous use of a unique container configuration that may aid in, in use, emptying of a powdered substance from that container employing devices and methods such as those discussed in detail in this disclosure is contemplated.

As used herein, the term "toner" generally refers to a powdered material used as the marking material in image forming devices such as xerographic image forming devices, laser printers and photocopiers to form printed text and images on image receiving substrates.

As used herein, the term "toner cartridge" generally refers to a closed container in which toner is conveniently packaged for supply to customers and/or end users. Toner cartridges are customer replaceable consumable components that the customers or end-users install as complete replacement units in the image forming devices, which may be opened for access to the toner by an image forming device once the toner cartridge is installed in the image forming device.

Figure 1:
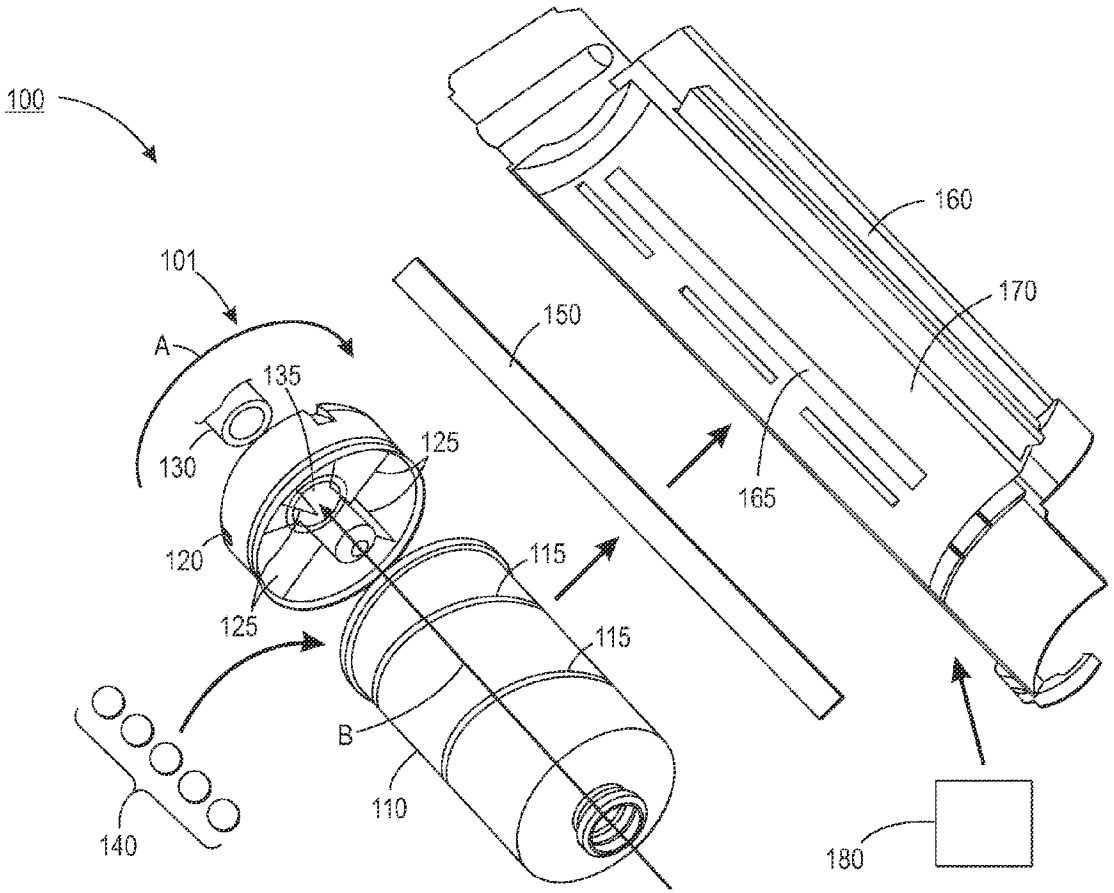
FIG. 1 is an exploded view of a system capable of reducing residual toner in a rotating container, according to one example embodiment.

FIG. 1 is a diagram of a system capable of reducing residual toner in a rotating container, according to one embodiment.

Certain image forming devices use powdered toner as the marking material for image forming on image receiving substrates. Toner is typically packaged in containers of differing sizes, shapes and compositions. These containers often include injection or blow molded container products. The containers may be generically referred to as "toner cartridges." Customers and/or end users need never interact directly with the toner itself.

Image forming devices today include monitoring capabilities for monitoring levels of all consumables, including toner. Upon an indication that any consumable, including toner in a particular toner cartridge, is nearly exhausted, the prudent customer or end-user will procure a replacement consumable component, in this case a toner cartridge, to have it at the ready. In this manner, when the image forming device advises the customer or end-user that the toner is exhausted, the customer or end user need only remove the exhausted component and replace it with a fresh, full component.

One particular configuration of toner cartridges are toner bottles that are generally circular in cross-sectional profile. These toner bottles are particularly configured to be rotated in the image forming device in which they are installed in a manner that causes the toner material contained in the toner bottles to be transported axially toward an opening at dispensing end of the toner bottles. The toner material in the toner bottle is then driven by an internal auger formed from internal helical features toward an axially central opening in the dispensing end, through which the toner material is transported out of the toner bottle to the image forming device for use.

Dispensing all of the toner material from a toner bottle can be challenging. Some percentage of the toner material typically adheres to all of the internal surfaces of the toner bottle, as the material is made to flow axially along the walls of the toner bottle to a dispensing end (endcap) of the toner bottle, and then from the wall of the toner bottle in the endcap radially to a centrally-located dispense point.

It is actually an observed problem in these types of toner bottles that the toner material, in having to slide across the inside surface of the toner bottle to be transported to the discharge end of the toner bottle, may do so inefficiently. When less than all of the toner material slides across the inside surfaces of the bottle, less than all of the toner material will be available to be dispensed from the toner bottle. This results in the toner material remaining in the toner bottle when the toner bottle is seemingly empty, resulting in waste.

Experience has shown that an image forming device may indicate that all of the toner material in a particular toner bottle has been exhausted when some significant amount of usable residual toner material remains in the particular toner bottle. Simple visual inspection of the toner bottle by a customer or end-user during the process of removal and replacement may confirm that a reasonable amount of residual toner remains in the particular toner bottle. Simple agitation of the particular toner bottle may result in, for example, dislodging the residual toner adhering to all of the internal surfaces of the particular toner bottle to make the residual toner available for use. If the apparently exhausted toner bottle is then reinserted in the image forming device, the residual toner material may be recovered and used by the image forming device.

In view of the above situation in conventional rotating toner bottle image forming devices, it would be advantageous to implement systems and methods by which to dislodge residual toner in the toner bottle so as to maximize toner cartridge life expectancy and thereby reduce of both time and materials required for replacing an empty toner cartridge without the need to remove the toner bottle from the image forming device to perform manual agitation.

To address this problem, a system 100 of FIG. 1 introduces the capability to reduce residual toner in a rotating container. FIG. 1 illustrates an exploded view of the system 100 which may be used to supply a powdered material such as a toner to an image forming device. The system 100 generally comprises a toner bottle system 101, a plurality of beads 140 inside the toner bottle system 101, a magnetic strip 150 external to the toner bottle system 101, and a housing 160 in which the toner bottle system 101 is installed. As shown in FIG. 1, the toner bottle system 101 generally includes a container body 110 and an endcap 120. As will be described in greater detail below, the container body 110 and the endcap 120, which are typically combined as a closed vessel, each include physical features that promote flow of toner contained in the toner bottle system 101 to a dispense end that includes a dispensing opening 135, through the endcap 120.

The particular physical features are shown in exemplary manner in the depiction in FIG. 1. The container body 110 may include helical features 115 molded into the wall of the container body 110. The helical features 115 are intended to act as an auger to move or push the toner in the toner bottle system 101 in the axial direction "B" toward the dispense end, i.e., the endcap 120 and dispensing opening 135, as the toner bottle system 101 is rotated in direction "A."

When the toner arrives at the endcap 120 at the dispense end of the toner bottle system 101, there are a plurality of surfaces 125 in the endcap 120 of the toner bottle. This plurality of surfaces 125, again as the toner bottle system 101 is rotated in direction "A," may be used to lift the toner and allow the toner to slide toward the centrally located dispensing opening 135. Once the toner is in the dispensing opening 135, the toner is fed into an image forming material transport conduit 130 of the image forming device in which the system 100 is installed.

But, as discussed above, some residual toner may remain among the helical features 115 and any surfaces inside the container body 110. Accordingly, the system 100 also includes the plurality of beads 140 and the magnetic strip 150. The plurality of beads 140 are carrier particles or other objects foreign to the toner container in the toner bottle system 101. The plurality of beads 140 may be any combination of spherical shaped and/or other shaped object that individually or conglomerately compliments a shape of a channel formed by the helical features 115 and an inner surface of the container body 110. The plurality of beads 140 comprise at least one material configured to be attracted the magnetic strip 150 such as iron, ferrous material, other metal, polymer or semiconductor having a particular charge.

When attracted to the magnetic strip 150, the plurality of beads 140 are configured to be relatively stationary and generally immobilized so that the plurality of beads 140 form a magnetic "brush" that cooperates with the helical features 115 and the internal surface of the container body 110 to transport at least a portion of the toner, such as a portion of the toner that would normally remain in the container body 110 if the plurality of beads 140 were not present within the system 100, in the axial direction "B." Any number of beads 140 may be included inside the toner bottle system 101 and the beads 140 may be of any size. In some embodiments, one bead 140 may be the size of a channel formed by the helical features 115 and the inner surface of the container body 110, or a plurality of beads 140 may magnetically bond to one another to fill a portion of the channel formed by the helical features 115 and the inner surface of the container body 110.

For example, if the plurality of beads 140 comprises carrier particles, the carrier particles may all be attracted to the magnetic strip 150 to form the magnetic brush. This magnetic brush has the effect of scavenging the toner from the inner walls of the container body 110, such as those formed by any of the inner surface of the container body 110 and the helical features 115, and collecting the toner in the bottom of the container body 110 so that the helical features 115, or other internal auger, for example, may move the toner to the dispensing opening 135 for use in the image forming device.

The magnetic strip 150 is configured to be stationary with respect to the container body 110 as the system 100, and may be configured to be any of constantly magnetized, or magnetized on demand. If configured to be magnetized on demand, the plurality of beads 140 may be generally free flowing inside the toner bottle system 101 until the magnetic strip 150 is magnetized. Regardless of whether the magnetic strip 150 is configured to be magnetized on demand or is continually magnetized, the plurality of beads 140 may also be driven by the helical features 115 along with the toner toward the dispensing opening 135. In some embodiments, the toner bottle system 101 may be configured to trap the plurality of beads 140, for example by configuring the endcap 120 to include a carrier particle trap, so that the beads do not exit the toner bottle system 101, or the plurality of beads 140 may be allowed to pass through the dispensing opening 135 into the image forming device or a carrier particle recovery device associated with the image forming device.

According to various embodiments, the magnetic strip 150 is held in a stationary position by the housing 160 a surface of the housing 160 which may include a slot 165 such that the magnetic strip 150 is positioned opposite an external surface of the container body 110 when the toner bottle system 101 is received by the housing 160. The magnetic strip 150 is positioned such that the magnetic strip 150 extends in a direction parallel to the axial direction "B." The plurality of beads 140, are attracted to the magnetic strip 150 when the magnetic strip 150 is magnetized and the toner bottle system 101 is installed within the housing 160. The plurality of beads 140, as discussed above, form a magnetic brush inside the toner bottle system 101. The magnetic brush formed by the plurality of beads 140 extends in a direction that corresponds with a maximum length dimension of the magnetic strip 150, i.e. in a direction parallel to axial direction "B."

In some embodiments, the housing 160 may further include a shield portion 170 configured to restrict a range of a magnetic field associated with the magnetic strip 150 to at least an area associated with the plurality of beads 140 as the toner bottle system 101 is rotated, for example, to protect various elements of the image forming device from the magnetic field formed by at least the magnetic strip 150.

According to various embodiments, the system 100 may further comprise a control module 180 that communicates with at least one processor and at least one memory including computer program code for one or more programs, the at least one memory and the computer program code configured to, with the at least one processor, cause the plurality of beads 140 to be attracted to the magnetic strip 150, if the magnetic strip 150 is configured to be magnetized on demand.

Figure 2:
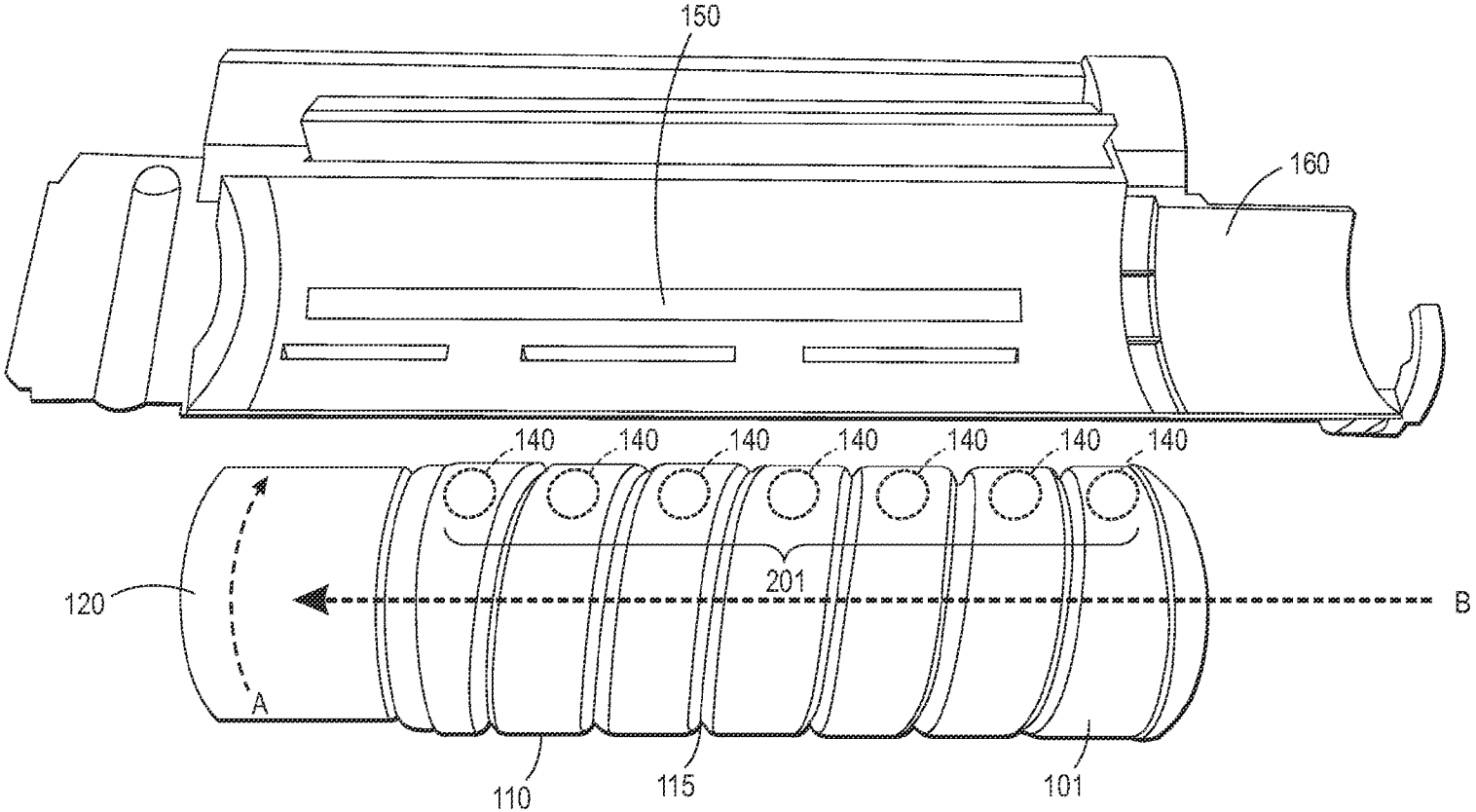
FIG. 2 is a diagram of a partially assembled system capable of reducing residual toner in a rotating container, according to one example embodiment.

FIG. 2 illustrates an assembled toner bottle system 101 having the plurality of beads 140 within the toner bottle system 101. The magnetic strip 150 is positioned on a surface of the housing 160 opposition an external surface of the toner bottle system 101. Though the toner bottle system is not installed in to housing 160 in this illustration, the plurality of beads 140 are illustrated as being attracted to the magnetic strip 150 to form a "magnetic brush" 201 as if the toner bottle system 101 were received by the housing 160 for ease of illustration and discussion purposes. It should also be noted that while the plurality of beads 140 are generally illustrated as being spherical and individually placed in channels formed by the helical features 115 and the inner surface of the container body 110, the illustrated beads 140 may also represent clusters of beads 140 or particles that attract to one another to form the magnetic brush 201.

In this example, the toner bottle system 101 is configured to rotate in the direction "A," as discussed above, to cause the toner within the toner bottle system 101 to be moved toward the endcap 120. The magnetic brush 201 formed from the plurality of beads 140 as they are attracted to the magnetic strip 150 sweep the inside of the container body 110 of the toner bottle system 101 cleaning any residual toner from the inner surface of the container body 110 allowing the helical features 115 to move the toner in the direction "B" toward the endcap 120 for dispensing into the image forming device.

Figure 3A:
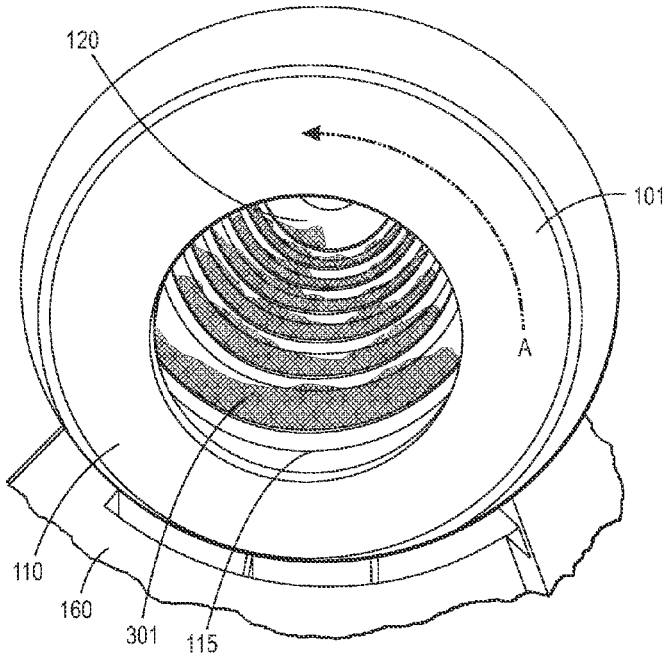
FIG. 3*a* is a diagram of a system capable of reducing residual toner in a rotating container when a magnetic strip of the system is not magnetized.
Figure 3B:
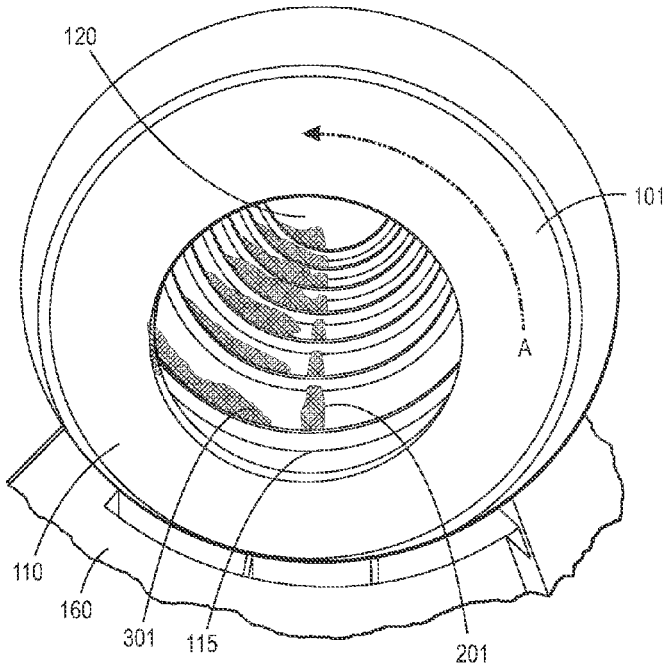
FIG. 3*b* is a diagram of a system capable of reducing residual toner in a rotating container when a magnetic strip of the system is magnetized.

FIGS. 3*a* and 3*b* illustrate the effects the magnetic brush 201 formed by the plurality of beads 140 has on toner 301 as the toner bottle system 101 rotates in the direction "A."

FIG. 3*a* illustrates a perspective view from an end portion of the container body 110 facing the direction "B," discussed above, toward the endcap 120. In this example, toner bottle system 101 is installed in the housing 160, but the magnetic strip 150 (not shown) is not magnetized. Accordingly, no magnetic brush is formed in FIG. 3*a*. As such, while the toner 301 is driven toward the dispensing end of the toner bottle system 101, some residual toner 301 remains attached to the helical features 115 and any inner surfaces of the container body 110 within channels formed by the helical features 115 and the inner surface of the container body 110.

FIG. 3*b* illustrates a perspective view from the same end portion of the container body 110 facing the direction "B" toward the endcap 120 as shown in FIG. 3*a*. In this example, however, the magnetic strip 150 is magnetized. As such, when the toner bottle system 101 is received by the housing 160, the magnetic brush 201 is formed by the plurality of beads 140 in the direction "B," as discussed above. The magnetic brush 201 causes the residual toner 301 to be scraped from the helical features 115 and the inner surfaces of the container body 110 so that the residual toner 301 can be driven by the helical features 115 toward the endcap 120 for dispensing into the image forming device.

According to this example, if the magnetic strip 150 were not magnetized as illustrated in FIG. 3*a*, or entirely absent, approximately 125 grams of residual toner 301 would have been wasted, which is equivalent to approximately 3000 printed sheets of a substrate. But, because the magnetic brush 201 is formed in FIG. 3*b*, a majority of this residual toner, if not all of the residual toner, is able to be recovered by the system 100 thereby maximizing the life expectancy of the toner bottle system 101 and reducing waste. It should be noted, however, that this reduction in residual toner and waste is merely an example to illustrate the effectiveness of the magnetic brush 201 and the system 100. The performance of the system 100 should not be considered to be limited to the above-discussed quantities relating to residual toner recovery and waste reduction performance.

Figure 4:
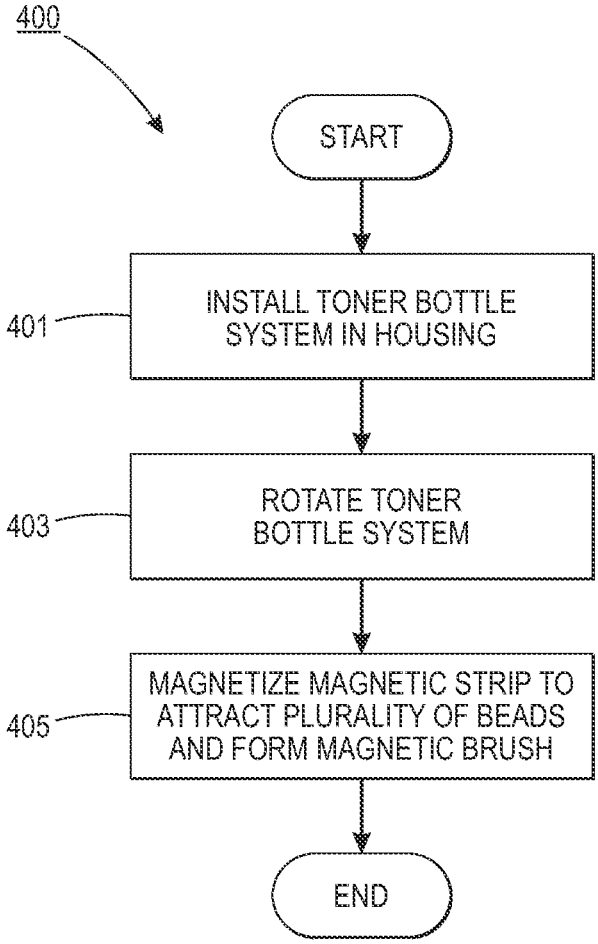
FIG. 4 is a flowchart of a process for reducing residual toner in a rotating container, according to one embodiment.

FIG. 4 is a flowchart of a process 400 for reducing residual toner in a rotating container, according to one embodiment. In step 401, a toner bottle system having helical features formed on an internal surface of a container body portion of the toner bottle system is installed in a housing configured to receive the toner bottle system. The housing, in this example, includes the magnetic strip on a surface of the housing. The toner bottle system is filled with toner and a plurality of beads configured to cooperate with the helical features and the internal surface of the container body. Next, in step 403, the toner bottle system is rotated in about an axis of rotation. Then, in step 405, the plurality of beads is caused to be attracted to the magnetic strip to form a magnetic brush. The magnetic strip, in this example, is configured to extend in a direction parallel to the axial direction of rotation of the toner bottle system and may be configured to always be magnetized or magnetized on demand as instructed by a control module, for example. Accordingly, the magnetic brush formed by the plurality of beads that are configured to cooperate with the helical features and the internal surface of the container body, transports at least a portion of the toner in the axial direction that corresponds with the axis of rotation, such as any residual toner that would normally be left attached to any helical features or internal surface of the container body.

The processes described herein for reducing residual toner in a rotating container may be advantageously implemented via software, hardware, firmware or a combination of software and/or firmware and/or hardware. For example, the processes described herein, may be advantageously implemented via processor(s), a Digital Signal Processing (DSP) chip, an Application Specific Integrated Circuit (ASIC), Field Programmable Gate Arrays (FPGAs), etc.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable operating and product processing environments in which the subject matter of this disclosure may be implemented for familiarity and ease of understanding. Physical components in this disclosure may be in the form or molded and injection molded structures. Although not required, embodiments of the disclosure may be provided, at least in part, in a form of hardware circuits, firmware, or software computer-executable instructions to carry out the specific functions described. These may include individual program modules executed by a processor.

Those skilled in the art will appreciate that other embodiments of the disclosed subject matter may be practiced in devices, including image forming devices, of many different configurations.

As indicated above, embodiments within the scope of this disclosure may include computer-readable media having stored computer-executable instructions or data structures that can be accessed, read and executed by one or more processors. Such computer-readable media can be any available media that can be accessed by a processor, general purpose or special purpose computer. By way of example, and not limitation, such computer-readable media can include one or more of dynamic memory (e.g., RAM, magnetic disk, writable optical disk, flash card, etc.) and static memory (e.g., ROM, CD-ROM, etc.) for storing executable instructions or data structures that when executed perform the steps described herein to reduce residual toner in a rotating container.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures represents one example of a corresponding sequence of acts for implementing the functions described in the steps of the above-outlined exemplary method. The exemplary depicted steps discussed above may be executed in any reasonable order to effect the objectives of the disclosed embodiments. No particular order to the disclosed steps of the disclosed method is necessarily implied any discussion or depiction, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure.

It will be appreciated that various of the above-disclosed and other features and functions, or alternatives thereof, may be desirably combined into many other different systems or applications. Also, various alternatives, modifications, variations or improvements therein may be subsequently made by those skilled in the art which are also intended to be encompassed by the following claims.

What is claimed is:

1. An apparatus useful in printing, comprising:

a rotatable vessel configured to contain a toner marking material, the rotatable vessel comprising a body section having a substantially round cross-section, a first end at one axial end of the body section, a second end axially distal from the first end, and helical features on an internal surface of the body section configured to transport at least a portion of the toner marking material in an axial direction between the first end and the second end as the rotatable vessel is rotated;

a magnetic strip configured to extend in a direction parallel to the axial direction substantially along an entire length of the body section between the first end and the second end of the rotatable vessel and to be held stationary with respect to the rotatable vessel as the rotatable vessel rotates; and a plurality of beads comprising at least one material configured to be attracted to the magnetic strip, the magnetic strip being switchably magnetized and demagnetized on demand, and when magnetized, causing the plurality of beads to be held stationary with respect to the rotatable vessel as the rotatable vessel rotates.

2. The apparatus of claim 1, further comprising:

a housing that receives the rotatable vessel, the magnetic strip being positioned on a surface of the housing opposite an external surface of the rotatable vessel when the rotatable vessel is received by the housing.

3. The apparatus of claim 1, further comprising:

a shield configured to restrict a range of a magnetic field associated with the magnetic strip to at least an area associated with the plurality of beads as the rotatable vessel is rotated.

4. The apparatus of claim 1, the helical features forming at least one channel having a shape and the beads being configured to complement the shape of the channel.

5. The apparatus of claim 1, wherein the beads are spherical.

6. A method useful in printing, comprising:

rotating a rotatable vessel containing a toner marking material and a plurality of magnetically-attractable beads, the rotatable vessel comprising a body section having a substantially round cross-section, a first end at one axial end of the body section, a second end axially distal from the first end, and helical features on an internal surface of the body section configured to transport at least a portion of the toner marking material in an axial direction between the first end and the second end as the rotatable vessel is rotated;

positioning a fixed magnetic strip externally and proximately to the rotatable vessel, the fixed magnetic strip extending in a direction parallel to the axial direction substantially along an entire length of the body section between the first end and the second end of the-rotatable vessel and being held stationary with respect to the rotatable vessel as the rotatable vessel rotates; and selectively magnetizing the fixed magnetic strip to cause the plurality of beads to be attracted to the fixed magnetic strip, the plurality of magnetically-attractable beads being formed of a material that is magnetically attracted to the fixed magnetic strip, the plurality of beads being held stationary with respect to the rotatable vessel as the rotatable vessel rotates.

7. The method of claim 6, further comprising installing the rotatable vessel in a housing that is configured to receive the rotatable vessel and to position an outer surface of the body section of the rotatable vessel in proximity to the magnetic strip.

8. The method of claim 6, the helical features forming at least one channel having a shape and the beads being configured to complement the shape of the channel.

9. The method of claim 6, wherein the beads are spherical.

10. An image forming device, comprising:

an image marking device; and at least one rotating toner marking material delivery unit, comprising:

a rotatable vessel configured to contain a toner marking material, the rotatable vessel comprising a body section having a substantially round cross-section, a first end at one axial end of the body section, a second end axially distal from the first end, and helical features on an internal surface of the body section configured to transport at least a portion of the toner marking material in an axial direction between the first end and the second end as the rotatable vessel is rotated;

a magnetic strip configured to extend in a direction parallel to the axial direction substantially along an entire length of the body section between the first end and the second end of the rotatable vessel and to be held stationary with respect to the rotatable vessel as the rotatable vessel rotates; and a plurality of beads comprising at least one material configured to be attracted to the magnetic strip, the magnetic strip being switchably magnetized and demagnetized on demand, and when magnetized, causing the plurality of beads to be held stationary with respect to the rotatable vessel as the rotatable vessel rotates.

11. The image forming device of claim 10, further comprising:

a housing that receives the rotatable vessel, the magnetic strip being positioned on a surface of the housing opposite an external surface of the rotatable vessel when the rotatable vessel is received by the housing.

12. The image forming device of claim 10, further comprising:

a shield configured to restrict a range of a magnetic field associated with the magnetic strip to at least an area associated with the plurality of beads as the rotatable vessel is rotated.

* * * * *